United States Patent [19]

Tanaka

[11] Patent Number: 4,853,729

[45] Date of Patent: Aug. 1, 1989

[54] DENTAL X-RAY FILM DEVELOPING MACHINE

[75] Inventor: Hiroyuki Tanaka, Yokohama, Japan

[73] Assignee: Nix Company, Ltd., Tokyo, Japan

[21] Appl. No.: 136,998

[22] Filed: Dec. 23, 1987

[30] Foreign Application Priority Data

Oct. 1, 1987 [JP] Japan ..... 62-149313[U]

[51] Int. Cl.[4] ..... G03D 3/10

[52] U.S. Cl. ..... 354/322; 354/344

[58] Field of Search ..... 354/316, 319, 320, 321, 354/322, 344, 345

[56] References Cited

U.S. PATENT DOCUMENTS

| | | | |
|---|---|---|---|
| 1,197,544 | 9/1916 | Rediske | 354/345 |
| 3,317,973 | 5/1967 | Finkle | 354/345 |
| 3,443,503 | 5/1969 | Holm et al. | 354/316 |
| 4,162,841 | 7/1979 | Dragone | 354/322 |
| 4,397,536 | 8/1983 | Zwettler | 354/322 |
| 4,410,257 | 10/1983 | Thebault | 354/322 |

*Primary Examiner*—A. A. Mathews

*Attorney, Agent, or Firm*—Wegner & Bretschneider

[57] ABSTRACT

A dental X-ray film developing machine is described. The machine has plural compartments arranged along a predetermined travelling path of a dental X-ray film to be developed. A film-mounting member is provided to mount the film detachably thereon. The film-mounting member is supported pivotally and releasably by a support. The plural compartments and support are displaceable relative to each other so as to allow the film to travel successively through the compartments.

21 Claims, 7 Drawing Sheets

DENTAL X-RAY FILM DEVELOPING MACHINE

BACKGROUND OF THE INVENTION

1. Field of the Invention

This invention relates to a dental X-ray film developing machine for developing one or more exposed dental X-ray films.

2Description of the Related Art

X-ray pictures of teeth have been used for the diagnosis and treatment of teeth in recent years. X-Ray photography of a tooth for obtaining its X-ray picture is effected by bringing an opaque dental X-ray film package, which contains an X-ray film sealed therein, into a diseased part within a mouth and then exposing the X-ray film to X-rays through the diseased part. By this X-ray photography, a latent image of the tooth is formed on the X-ray film. After completion of the X-ray photography, the X-ray film package is take out of the mouth and is then opened in a dark room or dark box to take out the X-ray film. The X-ray film thus taken out is processed for its development, for example, is developed, fixed and washed, whereby an X-ray picture of the thus-taken tooth is obtained on the X-ray film.

A variety of automatic developing machines has heretofore been proposed in order to perform the above development easily without labor. Many of such conventional developing machines have a structure that a developing bath, fixing bath, washing bath, etc. are provided, two sets of paired rollers are arranged in each bath, the individual rollers are rotated, an exposed X-ray film is nipped between the paired rollers in one set and is fed to the paired rollers in the other set, and this procedure is repeated successively in the developing bath, fixing bath and washing bath so as to conduct its development.

Among these automatic developing machines, an automatic developing machine permitting a size reduction of the overall structure has been proposed in Japanese Utility Model Publication No. 20115/1985. Some of its structural features will next be described with reference to FIG. 1.

FIG. 1 is a cross-sectional side view of the conventional automatic film developing machine proposed in the above publication. Numerals 1,2 indicate film feed rollers provided in a pair and letter a indicates their nip. Numeral 3,4 indicate film feed rollers provided in a pair in opposition to the film feed rollers 1,2. The nip of the film feed rollers 3,4 is also designated by a. The line connecting both nips a,a (i.e., the line shown by a phantom in FIG. 1) is substantially horizontal and the distance between the nips a,a is set slightly shorter than the length of a film as measured in the direction of its conveyance. There are also illustrated a catch pan 5 provided underneath the paired film feed rollers 1,2,3,4, a bottom wall 5*a* of the catch pan 5, and a raised central portion 5*a*' of the bottom wall 5*a* of the catch pan 5. Symbol 5*b* indicates both side walls of the catch pan 5. However, only one of the side walls 5*b* is shown in FIG. 1. A space 6 is formed by the film feed rollers 1,2,3,4, catch pan 5 and side walls 5*b*. Designated at numerals 7,8 are blades provided respectively in elastic contact with the rollers 2,4 in order to avoid leakage of a developer from the space 6. Numeral 9 indicates an overflow outlet formed through the side wall 5*b* . Designated at numeral 10 is a return pipe for collecting the developer overflowed to the outside from the space 6 and then recycling same to an unillustrated reservoir. Numeral 11 indicates a developer feed line for feeding the developer, which has been pumped up from the unillustrated reservoir, into the space 6.

When the developer is pumped up from the unillustrated reservoir and is then charged into the space 6 via the developer feed pipe 11, the level of the developer rises in the space 6 and eventually reaches the height of the overflow outlet 9. When the developer is fed further, the developer overflows through the overflow outlet 9 to the outside of the space 6. The thus-overflowed developer is then recycled to the unillustrated reservoir through the return pipe 10. As a result, the level of the developer is always maintained at the height of the overflow outlet 9. As shown in FIG. 1, the overflow outlet 9 is formed at a height higher than the line which connects the nips a,a to each other. When the film feed rollers 1,2,3,4 are rotated in a direction indicated by arrows and a film to be developed is fed between the film feed rollers 1,2 on the left-hand side as viewed in the drawing, the film passes from the film feed rollers 1,2 and then through the developer in the space, and is thereafter fed out of the space 6 while being pinched between the film feed rollers 3,4.

A processing unit adapted to perform processing of a film with a developer has been described above. Exactly the same processing unit can also be used for both fixing and washing. These processing units are arranged in the order of the developing unit, fixing unit and washing unit. Accordingly, a film can be developed surely without being bent. The developing machine can therefore be constructed into a relatively small size because it uses only two sets of paired rollers, which sets are arranged in an opposing relation, for feeding a film.

Although the above-described conventional automatic developing machine has various advantages, each processing unit requires the rollers 1–4 and catch pan 5. It is also necessary to provide, in addition to the space 6, the reservoir for the corresponding processing liquid as well as a pump and feed pipe (e.g., developer feed pipe 11) for feeding the processing liquid from the reservoir to the space 6. A further means is also required to collect the processing liquid overflowed from the space 6 and then to return it to the corresponding reservoir. The conventional automatic developing machine is therefore accompanied by such drawbacks that its structure is very large and complex and its manufacturing cost is high.

SUMMARY OF THE INVENTION

An object of this invention is therefore to solve the above-described problems of the prior art and hence to provide an automatic dental film developing machine which has a simple and compact construction, develops less troubles, can be manufactured at a lower cost, and can reduce its installation space significantly.

In one aspect of this invention, there is thus provided an automatic dental X-ray film developing machine, which comprises:

plural compartments arranged along a predetermined travelling path of a dental X-ray film to be developed;

a film-mounting member adapted to mount the dental X-ray film detachably thereon;

a support for pivotally and releasably supporting the film-mounting member thereon;

a means for causing a relative displacement between the plural compartments and support so as to allow the film to travel successively through the compartments.

In another aspect of this invention, there is also provided an automatic dental X-ray film developing machine, which comprises:

an annular member composed of a bottom wall, an outer peripheral wall, an inner peripheral wall and at least one partition wall, said at least one partition wall dividing an annular space, which is defined by the bottom wall, outer peripheral wall and inner peripheral wall, into plural compartments;

a film-mounting member adapted to mount a dental X-ray film detachably thereon;

a support for pivotally and releasably supporting the film-mounting member so as to allow the film to travel successively through the compartments; and a drive source for causing a relative angular displacement between the annular member and the support.

In a further aspect of this invention, there is also provided an automatic dental X-ray film developing machine, which comprises:

plural compartments arranged in a row;

a travelling member capable of travelling along the compartments;

a support fixed on the travelling member so that the support is caused to travel along and above the compartments; and a film-mounting member held pivotally and releasably on the support and adapted to mount a dental X-ray film thereon.

In the automatic dental X-ray film developing machine according to the first aspect of this invention, the compartments are filled directly with a developer, a fixer and the like, respectively, or a developer-containing container, a fixer-containing container and the like are inserted in the respective compartments. The film-mounting member with the dental X-ray film mounted thereon is connected to the support in such a way that the film-mounting member is pivotal in the travelling direction of the film. The means is then actuated. As a result, the plural compartments and support are caused to undergo a relative displacement so as to allow the film to travel successively through the processing liquids in the individual compartments. The development of the dental X-ray film is hence performed while it travels through the processing liquids in the above-described manner.

In the automatic dental X-ray film developing machine according to the second aspect of this invention, the compartments divided by the partitions are filled directly with a developer, a fixer and the like, respectively, or a developer-containing container, a fixer-containing container and the like are inserted in the respective compartments. The film-mounting member with the dental X-ray film mounted thereon is connected to the support in such a way that the film-mounting member is pivotal in the travelling direction of the film. The drive source is then actuated. As a result, the support is caused to move along and above the annular space or the annular member is caused to rotate to allow the annular space to pass under the support, whereby the dental X-ray film mounted on the film-mounting member is caused to travel successively through the processing liquids in the individual compartments. The development of the dental X-ray film is hence performed while it travels through the processing liquids in the above-described manner.

In the automatic dental X-ray film developing machine according to the third aspect of this invention, the compartments are filled directly with a developer, a fixer and the like, respectively, or a developer-containing container, a fixer-containing container and the like are inserted in the respective compartments. The X-ray film, which has been taken out of a dental X-ray film pack, is mounted on the film-mounting member. The film-mounting member is then connected to the support which is moving together with the travelling member, so that the X-ray film is allowed to pass successively through the processing liquids in the individual compartments and the development of the X-ray film is thus performed.

Automatic dental X-ray film developing machines according to the present invention can be simplified in structure and can be reduced in overall size. Accordingly, their manufacturing costs are reduced and their installation spaces can also be reduced significantly.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
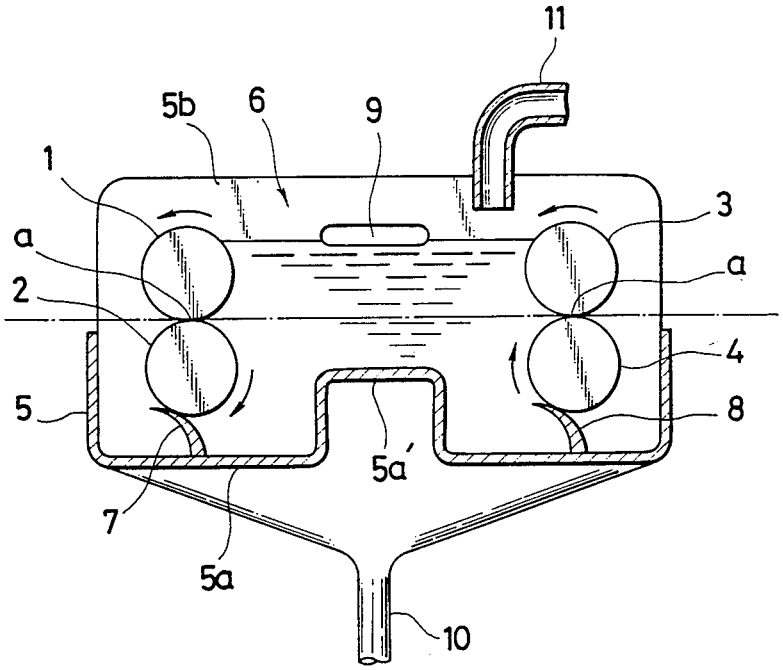
FIG. 1 PRIOR ART
FIG. 1 is the side cross-sectional view of the conventional automatic dental film developing machine.
Figure 2:
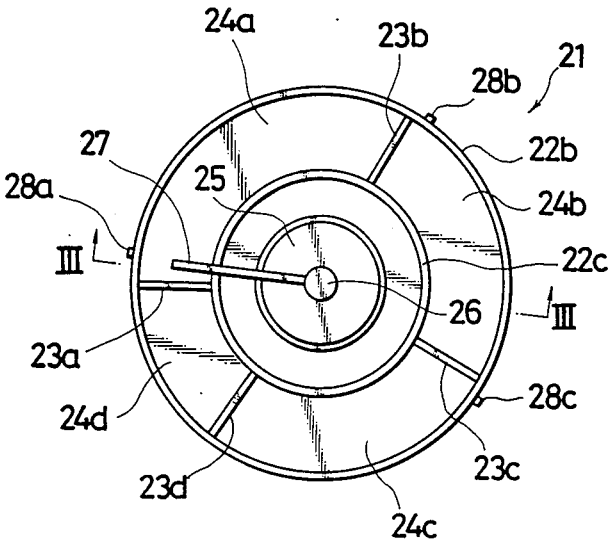
FIG. 2 is a plan view of an automatic dental X-ray film developing machine according to a first embodiment of this invention.
Figure 3:
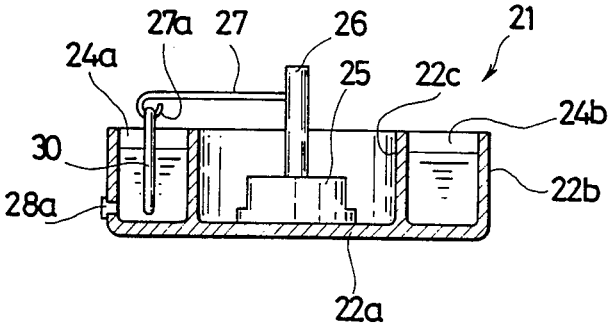
FIG. 3 is a cross-sectional view of the automatic dental X-ray film developing machine taken along line III—III in FIG. 1.

Referring first to FIGS. 2 and 3, numeral 21 indicates the automatic dental X-ray film developing machine according to the first embodiment of this invention. There are shown a circular bottom wall 22*a*, a cylindrical outer peripheral wall 22*a* provided upright from the peripheral edge of the bottom wall 22*b*, and a cylindrical inner peripheral wall 22*c* provided at a predetermined interval inside the outer peripheral wall 22*b*. An annular and groove-like space is formed by the bottom wall 22*a*, outer peripheral wall 22*b* and inner peripheral wall 22*c*. Designated at symbols 23*a*,23*b*, 23*c*,23*d* are partition walls provided radially between the outer peripheral wall 22*b* and inner peripheral wall 22*c*. The individual partition walls 23*a*–23*d* are arranged at predetermined intervals. Owing to the provision of the partition walls 23*a*–23*d*, the annular space has been divided into four compartments 24*a*,24*b*,24*c*,24*d*.

Numeral 25 indicates a motor mounted on the bottom wall 22*a* inside a cylindrical space formed by the bottom wall 22*a* and inner peripheral wall 22*c*. The drawings also illustrate a rotary shaft 26 connected to the motor 25 either directly or via a reducing gear unit, not shown, an arm 27 fixed at one end thereof on the rotary shaft 26 and extending radially from the rotary shaft 26, and a suspending portion 27*a* formed in the opposite, namely, free end of the arm 27. The free end, namely, the suspending portion 27*a* of the arm 27 is positioned above the annular space and approximately at midpoint between the outer peripheral wall 22*b* and inner peripheral wall 22*c*. Designated at symbols 28*a*,28*b*,28*c* are plugs closing their corresponding discharge openings formed through lower parts of the peripheral outer walls 22*b* of the respective compartments 24*a*,24*b*,24*c*. Numeral 30 indicates a holder as a film-mounting member, which is adapted to supporting a dental X-ray film thereon. The structure of the holder 30 will next be described with reference to FIGS. 4(*a*) and 4(*b*).

Figure 4:
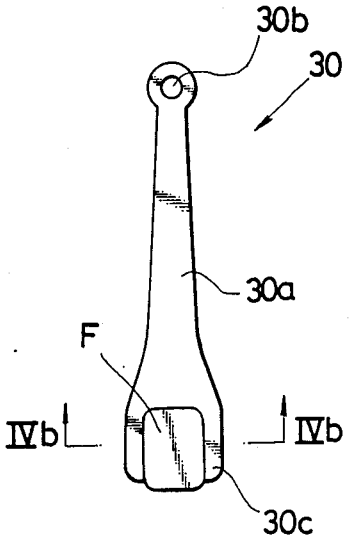
FIG. 4(*a*) is a front view of a film-mounting member depicted in FIGS. 2 and 3 and FIG. 4(*b*) is a cross-sectional view of the film-mounting member taken along line IV(*b*)–IV(*b*) in FIG. 4(*a*)
Figure 4B:
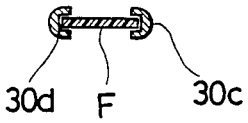

The holder 30 is composed of a main body 30*a*, a hole 30*b* formed through one end portion of the main body 30*a*, and a film-mounting portion 30*c* formed at the other end portion of the main body 30*a*. The film-mounting portion 30*c* is bifurcated as depicted in FIG. 4(*a*) and slots 30*d*,30*d* are formed respectively in inner edges of the bifurcated branches as shown in FIG. 4(*b*). By inserting both sides of a dental X-ray film F into the corresponding slots 30*d* from the free end of the film-mounting portion 30*c*, the dental X-ray film F is supported on the holder 30. The holder 30 is generally made of an elastic material, for example, an elastic plastic material so as to make effective use of the elasticity of the material upon insertion and removal of the film F while ensuring the holding of the film F in the course of its travelling through the compartments 24*a*,24*b*,24*c*,24*c*. The width of the slots 30*d*,30*d* is therefore determined in such a way that the slots 30*d*,30*d* are broad enough to facilitate the insertion and removal of the film F but are narrow enough to ensure the holding of the film F.

An electric circuit for the motor 25 as a drive source for the developing machine 21 of the first embodiment is now described with reference to FIG. 5, in which there are shown the motor 25 depicted in FIGS. 2 and 3, a power source 32, an automatic return pushbutton switch 33 which returns to the original state upon release of a hand, and a cam 34. This cam 34 is connected a suitable rotating part such as the rotary shaft of the motor 25, the unillustrated reducing gear unit or the rotary shaft 26 and is rotated in synchronization with the rotating part. Designated at symbol 34*a* is a recess formed in the cam 34. Numeral 35 indicates a microswitch, while symbol 35*a* designates an actuator of the microswitch 35. The microswitch 35 remains OFF as long as the actuator 35*a* is maintained in the recess 34*a* of the cam 34. The microswitch 35 is however ON when the actuator 35*a* is in any position outside the recess 34*a*. The pushbutton 33 and microswitch 35 are connected in parallel to each other. The pushbutton switch 33, cam 34 and microswitch 35 are mounted at suitable locations in the developing machine 21. Incidentally, the power source should of course be an a.c. power source when the motor is an a.c. motor.

A description will next be made of development processing making use of the developing machine of the first embodiment, while making reference to the electric circuit depicted in FIG. 5 and the operation illustrated schematically in FIG. 6. Incidentally, FIG. 6 is a drawing in which the individual compartments provided in the toroidal arrangement have been developed on a planar sheet. Upon processing for development, as illustrated in FIG. 6, the compartments 24*a*,24*b*24*c* are filled with a developer $S_1$, a fixer $S_2$ and a washing liquid (not shown) respectively but the compartment 24*d* is left as a space. The exposed X-ray film F is taken out of a dental X-ray film pack and is fit in the slots 30*d* of the holder 30 so as to support the film F. As illustrated in FIG. 3, the hole 30*b* of the holder 30 is fit on the hook of the suspending portion 27*a* of the arm 27 so that the holder 30 is suspended from the free end of the arm 27. As will be described subsequently, the arm 27 is set to assume the position shown in FIG. 2, namely, the position close to the partition wall 23*a* of the compartment 24*a*. The dental X-ray film F is therefore immersed in the developer when the holder 30 is suspended initially from the suspending portion 27*a* as described above.

When the pushbutton switch 33 is depressed immediately after the immersion of the dental X-ray film F in the developer, a current is fed to the motor 25 so that the motor 25 begins to rotate. Owing to this rotation of the motor 25, the rotary shaft 26 is rotated and the free end of the arm 27 starts moving approximately along the angular center line of the compartment 24*a*. As a result, the dental X-ray film F mounted on the film-mounting portion 30*c* of the holder 30 is caused to move through the developer $S_1$. On the other hand, the cam 34 also rotates in the direction indicated by the arrow in synchronization with the rotation of the rotary shaft 26. Shortly after the initiation of the rotation, the actuator 35*a* is caused to come out of the recess 34*a* of the cam 34. The microswitch 35 which has been in an OFF state is accordingly brought into an ON state. Even when the hand is released from the pushbutton switch 33 to bring it into an OFF state subsequent to its depression for a very short period of time, the microswitch 35 thereafter remains ON. The rotation of the motor 25 is thus continued so that the dental X-ray film F connected to the arm 27 by way of the holder 30 is caused to move through the developer $S_1$ in a direction indicated by an arrow in FIG. 6. In the course of this movement, the development of the dental X-ray film F is carried out.

When the dental X-ray film F approaches the partition wall 23b, the film-mounting portion 30c of the holder 30 is brought into contact with the tilted surface 22a' formed on the bottom wall 22a of the compartment 24a. As the arm 27 moves, the holder 30 is pivoted upwardly about the suspending portion 27a by the tilted surface 22a' and eventually rides on the partition wall 23b. When the arm 27 moves further, the film-mounting portion 30c moves on the partition wall 23b and then ride over the partition wall 23b. At this moment, the holder 30 is allowed to pivot downwardly about the suspending portion 27a, whereby the film-mounting portion 30c is dropped in the fixer $S_2$ in the compartment 24b to immerse the dental X-ray film F in the fixer $S_2$. The dental X-ray film F is thereafter caused to move through the fixer $S_2$ to conduct its fixing as the arm 27 moves.

In exactly the same manner, the dental X-ray film F moves from the compartment 24b into the compartment 24c so that the dental X-ray film F enters a washing liquid. While moving through the washing liquid, its washing is conducted. The dental X-ray film F them moves from the compartment 24c into the compartment 24d. While the dental X-ray film F passes through the compartment 24d, any washing liquid still remaining on the surfaces of the dental X-ray film F are allowed to drop.

Figure 5:
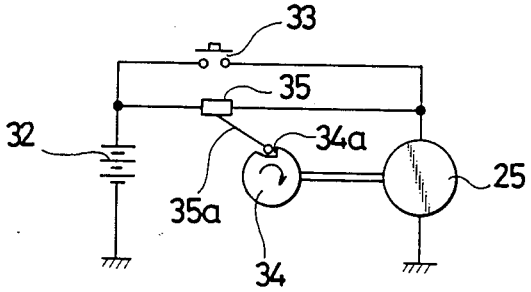
FIG. 5 is a circuit diagram of a drive circuit for a motor illustrated in FIGS. 2 and 3.
Figure 6:
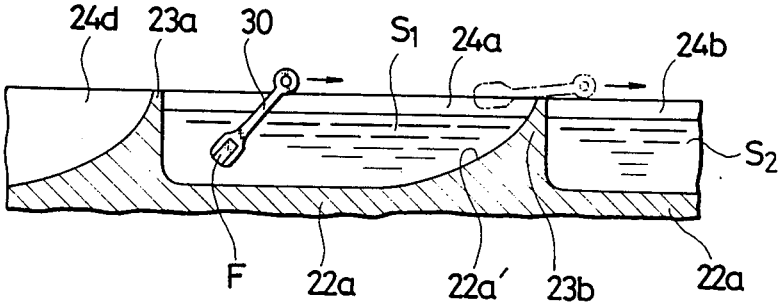
FIG. 6 is a schematic illustration of the operation of the automatic dental X-ray film developing machine shown in FIGS. 2 and 3.

When the rotary shaft 26 has undergone a full turn and returned its original position, the actuator 35a of the microswitch 35 falls in the recess 34a of the cam 34 to bring the microswitch 35 into the OFF state as illustrated in FIG. 5. Accordingly, the motor 25 stops and the rotary shaft 26 and arm 27 also stop. By this time, the arm 27 has returned to the starting position of its movement shown in FIG. 2. Since this starting position is close to the partition wall 23a as described above, the holder 30 is in a state indicated by broken lines in FIG. 6, namely in a state in which the holder 30 has ridden on the partition wall 23a. The holder 30 is detached from the arm 27 and the dental X-ray film F is removed from the film-mounting portion 30c of the holder 30. The development processing of the dental X-ray film F has now been completed, so that an X-ray picture of a tooth is shown there.

Figure 7:
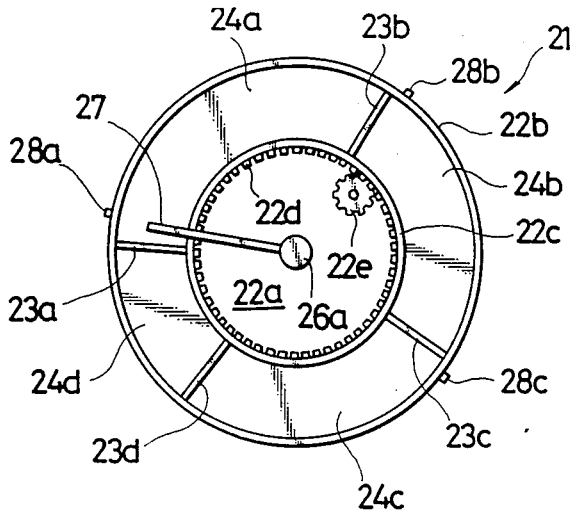
FIG. 7 illustrates a modification of the first embodiment, in which an arm is fixed and individual compartments are rotated.

In the first embodiment described above, the arm 27 is rotated. Apparently, it may also be possible to fix the arm and instead to rotate the individual compartments themselves. This modified embodiment is shown in FIG. 7. The arm 27 is fixed on the bottom wall 22a via a post 26a. Teeth 22d are formed on the entire periphery of the inner peripheral wall 22c. A pinion 22e, which is connected to an unillustrated drive source such as the motor 25, is brought into meshing engagement with the teeth 22d. When the unillustrated drive source is actuated, the individual compartments 24a,24b,24c,24d are rotated via the pinion 22b and teeth 22d. As an alternative, the teeth 22d may be provided on the entire periphery of the outer peripheral wall 22b.

In the first embodiment described above, the four compartments are provided and the first three compartments are filled successively with a developer, a fixer and a washing liquid and the last compartment is left as a space. It is however not necessary to limit the first embodiment to the above particular structure. For example, the last compartment employed as a space may be omitted so that only three compartments are provided. As a further alternative, the four compartments may be filled with a developer, a washing liquid, a fixer and another washing liquid, successively. As a still further alternative, the compartments may be reduced to two compartments to be filled with a developer and a fixer respectively and the washing may be conducted outside. As a still further alternative, a compartment may be formed as a space and a heater may be provided therein to use it as a drying compartment. The angular lengths of the individual compartments as viewed in the travelling direction may be varied depending on the time periods required for the corresponding processing operations. In the first embodiment described above, a tilted surface is formed in each compartment. It is however apparent from the above description that such a tilted surface is not essential.

Figure 8:
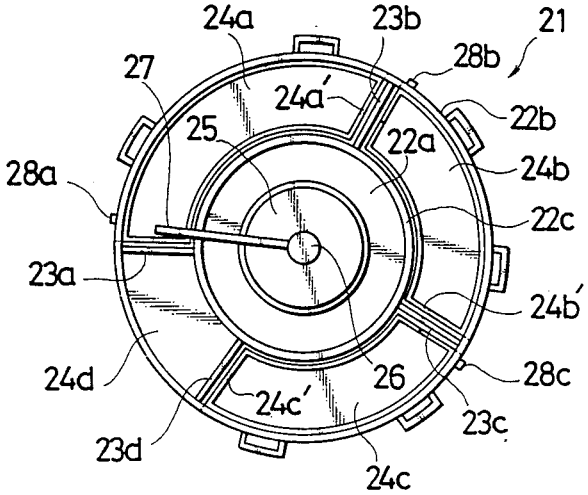
FIG. 8 shows another modification of the first embodiment, in which a developer-containing container, fixer-containing container and washing-liquid containing container are placed in individual compartments.

In the first embodiment described above, the individual compartments are filled directly with a developer, a fixer and a washing liquid respectively. It is however feasible to provide separately containers which contain a developer, a fixer and a washing liquid respectively. These containers are then inserted and placed in the respective compartments. Namely, the so-called cartridge method may be used. This method facilitates the replacement of the processing liquids. This modified embodiment is illustrated in FIG. 8. A developer-containing container 24a', fixer-containing container 24b' and washing-liquid containing container 24c' are placed in the compartments 24a,24b,24c respectively. The containers 24a',24b',24c' are inserted into and removed from the corresponding compartments 24a,24b,24c through openings which are formed through the outer peripheral wall 22b.

Further, the structure of the holder is not limited to that employed in the first embodiment and holders of various structures may be used. Any holder may be used so long as it can support a dental X-ray film surely and releasably and its connection with the arm is pivotal in the advancing direction. The structure of the first embodiment has been described above, assuming that the developing machine would be installed in a dark room. In order to convert the structure into a dark-box structure, it is necessary to provide a cover on the top of the developing machine of the first embodiment to form the entire structure into a dark box and also to provide hand access holes through the cover while paying attention not to permit invasion of external light. The structure of such hand access holes has been well-known in the art. In a developing machine of such a dark box structure, an exposed dental X-ray film pack is placed as is in the developing machine constructed as a dark box. The dental X-ray film is manually taken out of the pack by feel and then mounted on the holder, and the holder is thereafter hooked on the arm.

Figure 9:
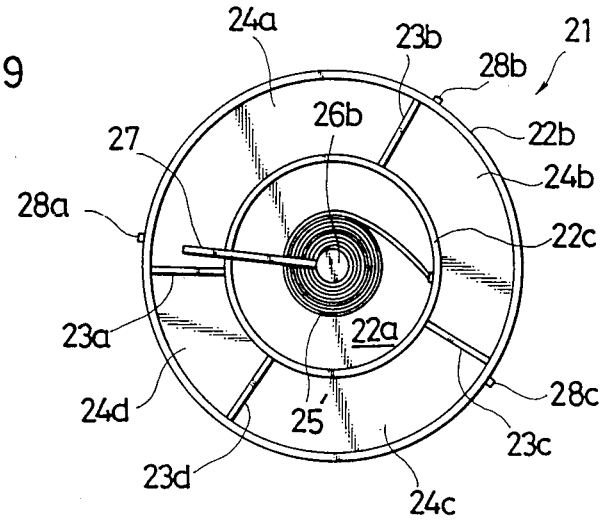
FIG. 9 depicts a further modification of the first embodiment, in which power accumulated in a spring is used as a drive source.

In the first embodiment described above, the motor is used as a drive source by way of example. It is however possible to use various other drive sources, for example, a drive source making use of power accumulated in a spring. This modified embodiment is shown in FIG. 9. A rotary shaft 26' is supported rotatably on the bottom wall 22a. A spring 25' is provided around the rotary shaft 26' with one end fixed on the rotary shaft 26' and the other end fixed on the bottom wall 22a. Power adapted to rotate the rotary shaft 26' may be accumulated in the spring by tightening up the spring 25' by a method known per se in the art.

The space is not necessarily limited to the annular shape. It may take, for example, a polygonal annular shape.

As has been described above, in the first embodiment, the annular space is constructed by the bottom wall, outer peripheral wall and inner peripheral wall and is divided into the plural compartments, and the free end of the arm as a travelling member is caused to move along the annular space by means of the drive source. The developing machine of the first embodiment has a simple structure and its overall dimensions can be reduced. It is hence possible to minimize troubles and to reduce the manufacturing cost. It also facilitates transportation and installation.

The second embodiment of this invention will next be described with reference to FIGS. 10–13. Numeral 41 indicates a housing constructed light-proof. As apparent from FIGS. 10 and 11, its overall structure is constructed into a thin and flattened shape. Designated at numeral 42 is a motor installed in a bottom portion of the housing 41 at a location adjacent to one end of the housing 41. There are also shown sprocket wheels 43*a*,43*b*,43*d*,43*e* provided at both ends of the housing 41. The sprocket wheels 43*a*,43*b* are fixed at a predetermined interval therebetween on a shaft 43*c*, while the sprocket wheels 43*d*,43*e* are fixed on a shaft 43*f* at the same interval as that between the sprocket wheels 43*a*,43*b*. Numeral 44 indicates a pulley mounted fixedly on the shaft 43*c* and numeral 45 designates a belt mounted between the pulley 44 and a pulley (not shown) of the motor 42.

Designated at symbol 46*a* is an endless travelling member mounted between the sprocket wheels 43*a* and 43*b*, while symbol 46*b* indicates another endless travelling member mounted between the sprocket wheels 43*b* and 43*e*. Through the travelling members 46*a*,46*b*, small holes 47 are bored at predetermined intervals. Teeth provided on the sprocket wheels 43*a*,43*b*,43*d*,43*e* enter the small holes 47. Numeral 48 indicates bar-like support members fixed at both ends thereof on the respective travelling members 46*a*,46*b*. The bar-like support members 48 are arranged at substantially constant intervals.

There are also depicted a developing bath 50, fixing bath 51, washing bath 52 and drying compartment 53. These developing bath 50, fixing bath 51, washing bath 52 and drying compartment 53 are arranged as an integral unit, successively in a row and along the length of the housing 41, and are supported on the housing 41 in such a way that they are positioned between the travelling members 46*a*,46*b*. Openings of the developing bath 50, fixing bath 51, washing bath 52 and drying compartment 53 therefore oppose the support members 48. Symbols 50*a*,51*a*,52*a*,53*a* indicate tilted surfaces formed in the respective baths 50,51,52 and the drying compartment 53, while symbol 53*b* designates an extension extending out from the drying compartment 53.

Designated at numeral 54 is a catch box for receiving dental X-ray films (hereinafter called merely "films") whose development processing operations have been completed. Symbol 54*a* indicates a handle of the catch box 54. A side wall of the catch box 54, on which side wall the handle 54*a* is provided, is fit in an opening formed through a side wall of the housing 41, whereby the catch box 54 can be easily pulled out of the housing 41 at the handle 54*a* and the external light is prevented from flowing into the housing 41. Numeral 55 indicates a dark box 55 provided on the top wall of the housing 41 at an end portion of the housing 41, which end portion is on the side of the developer tank 50. Designated at symbol 55*a* is an access hole which permits insertion of hands into the dark box 55 from the outside. Although not shown, a known light-shielding bag is externally provided with the access hole 55*a*. Another access hole of the same type as the above access hole 55*a* is also formed through the opposing side wall of the dark box 55 so as to allow an operator to use both hands in the dark box. By the way, symbol 41*a* indicates an opening formed through the top wall of the housing 41 at a location facing the dark box 55.

Figure 12A:
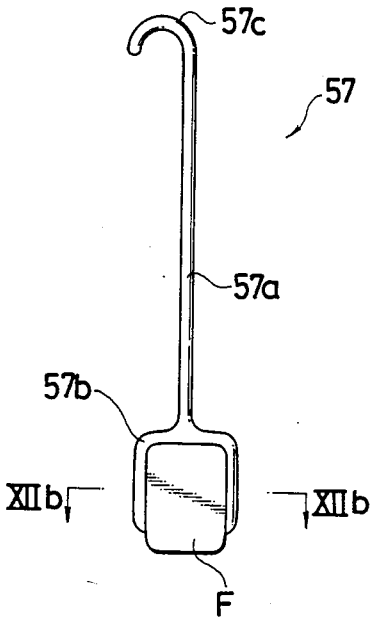
FIG. 12(*a*) is a front view of a film-mounting member shown in FIG. 10, and FIG. 12(*b*) is a cross-sectional view of the film-mounting member taken along line XI*b*—XI*b* in FIG. 11(*a*)
Figure 12B:
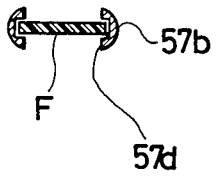

Designated at numeral 57 are holders which are adapted to mount a film thereon. Each holders 57 is suspended from one of the support members 48. The holders 57 are shown in more detail in FIGS. 12(*a*) and 12(*b*). Each holder 57 is composed of a rod 57*a*, a film-mounting portion 57*b* provided at one end of the rod 57*a*, and a hook 57*c* provided at the other end of the rod 57*a*. The film-mounting portion 57*b* is bifurcated and slots 57*d*,57*d* are formed respectively in inner edges of the bifurcated branches so that the film F may be inserted in the slots 57*d*,57*d* as shown in FIG. 12(*b*). Each holder 57 is generally made of an elastic material, for example, an elastic plastic material so as to make effective use of the elasticity of the material upon insertion and removal of the film F while ensuring the holding of the film F in the course of its travelling through the baths 50,51,52 and compartment 53. The width of the slots 57*d*,57*d* is therefore determined in such a way that the slots 57*d*,57*d* are broad enough to facilitate the insertion and removal of the film F but are narrow enough to ensure the holding of the film F.

The operation of the second embodiment will next be described. The developing bath 50, fixing bath 51 and washing bath 52 are filled with a developer, a fixer and water, respectively. The unillustrated heater in the drying compartment 53 is actuated. The motor 42 is also driven to rotate the shaft 43*c* via the pulley 44. The sprocket wheels 43*a*,43*b* are thus rotated in a direction indicated by arrow A in FIG. 10, whereby the travelling members 46*a*,46*b* are caused to move from the left to the right above an imaginary line extending between the shaft 43*c* and the shaft 43*f* and from the right to the right below the same imaginary line, both, as viewed in FIGS. 10 and 11.

In the above state, an exposed dental X-ray film pack is placed in the dark box 55 and is opened to take out the film. The film thus taken out is mounted in the slot 57*d*,57*d* of the film-mounting portion 57*b* of the holder 57 which has been placed in advance in the dark box 55. Through the opening 41*a*, the holder 57 with the film mounted thereon in the above-described manner is then suspended at the hook 57*c* from the support member 48 which is moving from the left to the right as viewed in FIGS. 10 and 11. As a result, the film is immediately brought into the developer in the developing bath 50. As the support member 48 travels, the film is also allowed to move through the developer. In the course of this movement, the development processing of the film is carried out.

Figure 10:
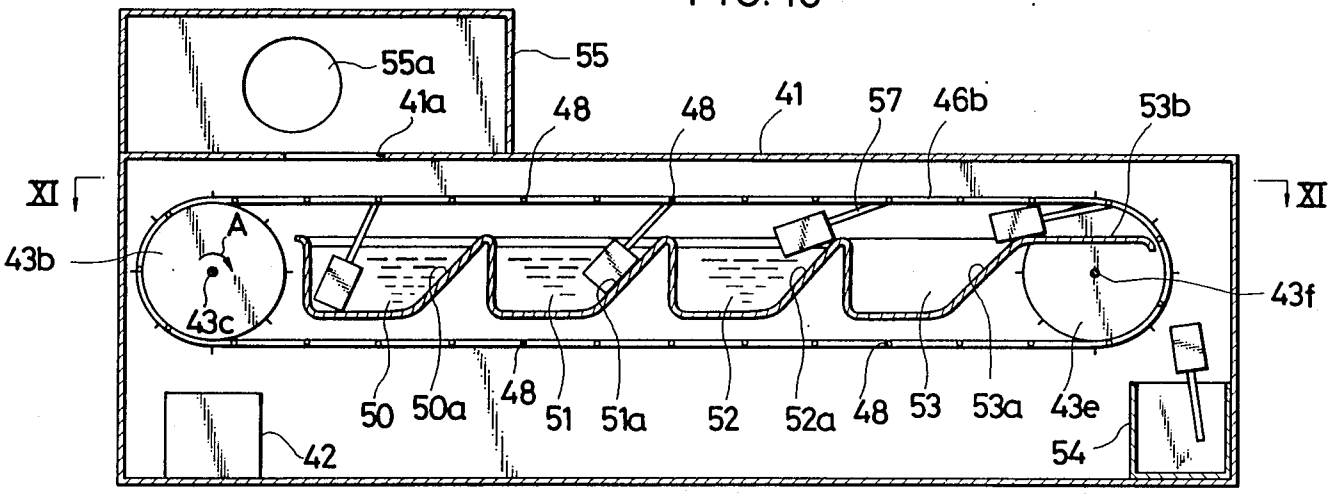
FIG. 10 is a vertical cross-sectional view of an automatic dental X-ray film developing machine according to a second embodiment of this invention, taken along line X—X in FIG. 11.
Figure 11:
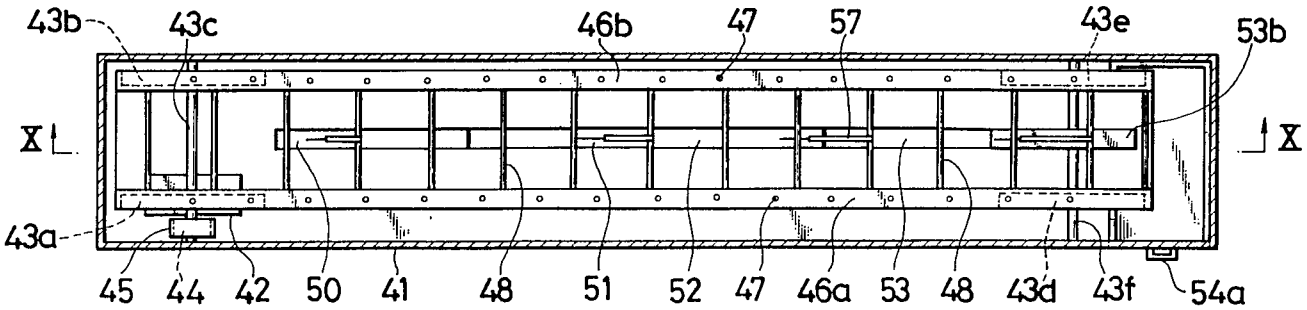
FIG. 11 is a horizontal cross-sectional view of the automatic dental X-ray film developing machine, taken along line XI—XI in FIG. 10.

When the support member 48 travels further, the film reaches the tilted surface 50*a* of the developing bath 50 and is pulled upwards along the tilted surface 50*a* (this state is shown by the film in the fixing bath 51 in FIG. 10). A further movement of the support member 48 causes the film to reach the top boundary between the developing bath 50 and fixing bath 51 (this state is represented by the film in the washing bath 52). When the support member 48 travels further, the film rides over the top boundary and immediately drops into the fixing bath 51.

As the support member 48 with the film suspended therefrom travels further, the film is caused to move through the fixing bath 51, washing bath 52 and drying compartment 53 in exactly the same manner. As a result, its fixing, washing and drying are performed successively. The film which has been dried in the drying compartment 53 moves slidingly on the extension 53*b*. On the other hand, the corresponding support member 48 reaches a point between the sprocket wheels 43*d*,43*e*. As the support member 48 travels, its travelling direction changes downwards.

Figure 13:
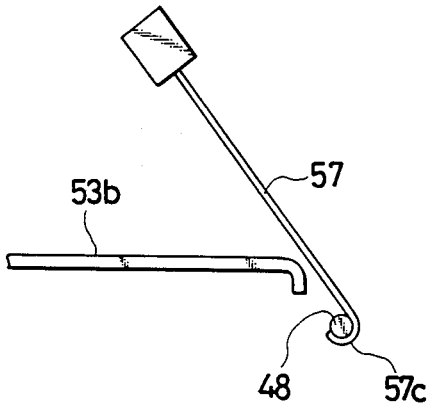
FIG. 13 is a schematic illustration of a support, the film-mounting member and an extension, all shown in FIGS. 10 and 11, when the automatic dental X-ray film developing machine of FIGS. 10 and 11 is being in operation.

FIG. 13 shows a state in which the travelling direction of the support member 48 has changed downwards. In this state, the holder 57 is brought into an outer edge of the extension 53*b* and as the support member 48 travels further, the holder 57 is being caused to stand with the film up. When the support member 48 has brought into an approximately upright position, the hook 57*c* is released from the support member 48 and the holder 57 drops into the catch box 54. By pulling out the catch box 54 at the handle 54*a* from the housing 41 and removing the film from the holder 57, the thus-developed film can be obtained with an X-ray picture of a tooth shown thereon.

It is understood clearly from the above description and the individual drawings that a plurality of films can be developed at the same time by suspending holders successively from the support members 48 as the support members 48 reach below the opening 41*a*.

In the second embodiment described above, two travelling members and two sets of paired sprocket wheels are employed. It is also feasible to use one travelling member and a pair of sprockets only. In such a modification, supports members may be supported in a cantilever fashion on the single travelling member or the free ends of the support members may be supported by a continuous guide member provided on a side wall of a housing. The travelling members may be belt-like travelling members. Other suitable members can also be employed, including chains. Further, the developing bath, fixing bath, washing bath and drying compartment may not be an integral unit but may be discrete from one another. Their lengths as viewed in the travelling direction may be varied depending on the time periods required for the corresponding processing operations. The drying compartment is not essential and may hence be omitted. In the second embodiment described above, a tilted surface is formed in each bath or compartment. It is however apparent from the above description that such a tilted surface is not essential.

Figure 14:
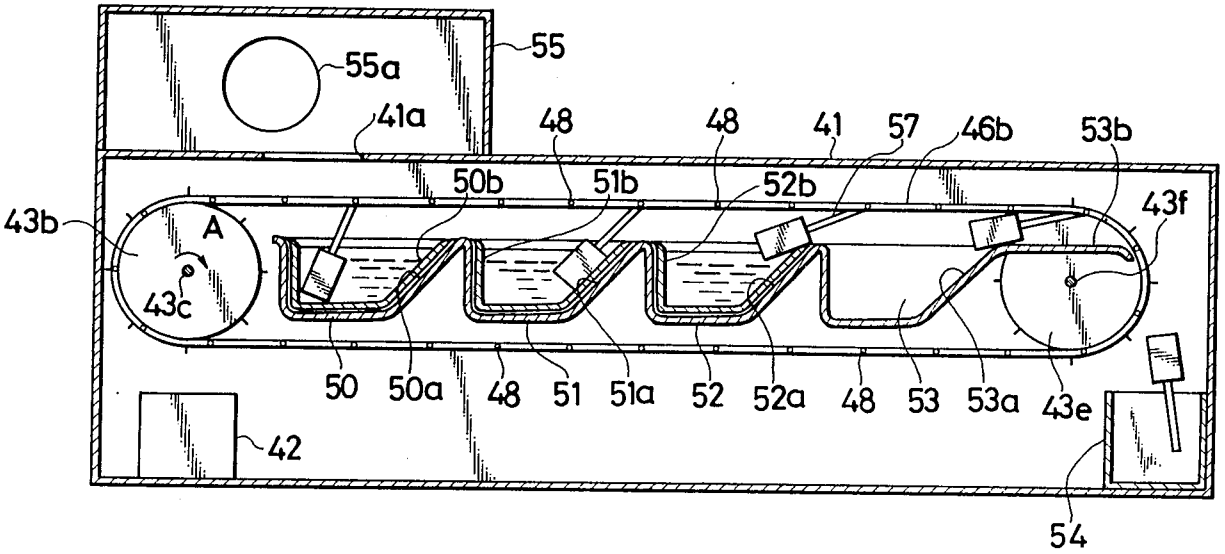
FIG. 14 illustrates a modification of the second embodiment, in which a developer-containing container, fixer-containing container and washing-liquid containing container are placed in individual compartments.

In the second embodiment described above, the individual baths are filled directly with a developer, a fixer and a washing liquid respectively. It is however feasible to provide separately containers which contain a developer, a fixer and a washing liquid respectively. These containers are then inserted and placed in the respective baths. Namely, the so-called cartridge method may be used. This method facilitates the replacement of the processing liquids. This modified embodiment is shown in FIG. 14. A developer containing container 50*b*, fixer-containing container 51*b* and washing-liquid containing container 52*b* are placed in the developing bath 50, fixing bath 51 and washing bath 52 respectively. Although not shown in FIG. 14, the rear wall of the housing 41 is hinged on the remaining part of the housing 41 and the rear walls of the baths 50,51,52 have been removed. Accordingly, the containers 50*b*,51*b*,52*b* can be easily inserted into and removed from the corresponding baths 50,51,52.

In the second embodiment, the two endless travelling members are caused to move by the sprocket wheels. Each holder with a film mounted thereon is suspended from one of the support members provided between the travelling members. The film is then caused to pass through the developing bath, fixing bath, washing bath and drying compartment, which are arranged in a row along the travelling direction of the travelling members. It is hence possible to perform the development processing by the extremely simple structure without need for many rollers or the like. It is also feasible to protect films from damages. Since the developing bath, fixing bath, washing bath and drying compartment are arranged in a row along the travelling direction of the travelling members, the overall structure can be constructed into a thin and flattened shape so that the space occupied by the developing machine can be reduced significantly. In addition, it is only necessary for the openings of the developing bath, fixing bath, washing bath and drying compartment to have a width sufficiently greater than the thickness of the film. These openings can hence have a narrow width, whereby the overall structure can be constructed still thinner and the air-contacted surface areas of the processing liquids can be reduced to minimize their deterioration. The latter advantage is especially meaningful for the developer.

I claim:

1. An automatic dental X-ray film developing machine, which comprises:

an annular member having a bottom wall, an outer peripheral wall, an inner peripheral wall and at least one partition wall, said at least one partition wall dividing an annular space, which is defined by the bottom wall, the outer peripheral wall and the inner peripheral wall, into plural compartments;

a film-mounting member having a first end and a second end, the first end having a holding portion for detachably holding a dental X-ray film at a pair of mutually opposing sides;

a support for pivotably and releasably supporting the film-mounting member so as to allow the film to travel successively through the compartments, said support engaging the second end of said film-mounting member; and drive means for causing a relative angular displacement between the annular member and the support.

2. The machine as claimed in claim 1, wherein the annular member comprises three partition walls to divide the annular space into a first compartment to be filled with a developer, a second compartment to be filled with a fixer and a third compartment to be filled with a washing liquid.

3. The machine as claimed in claim 1, wherein the annular member comprises four partition walls to divide the annular space into a first compartment to be filled with a developer, a second compartment to be filled with a fixer, a third compartment to be filled with a washing liquid, and a fourth compartment to be used as a drying compartment.

4. The machine as claimed in claim 1, wherein the annular member comprises three partition walls to divide the annular space into a first compartment, a second compartment, and a third compartment, further comprising a developer-containing container removably disposed in said first compartment, a fixer-containing container removably disposed in said second compartment, and a washing-liquid-containing container removably disposed in said third compartment.

5. The machine as claimed in claim 1, wherein the annular member comprises four partition walls to divide the annular space into a first compartment, a second compartment, a third compartment and a fourth compartment, further comprising a developer-containing container removably disposed in said first compartment, a fixer-containing container removably disposed in said second compartment, and a washing-liquid-containing container removably disposed in said third compartment, wherein said fourth compartment is a drying compartment.

6. The machine as claimed in claim 1, wherein the annular member is fixed, the support is an arm provided on a rotary shaft of the drive means, and an end portion of the arm travels along and above the annular space of the annular member.

7. The machine as claimed in claim 1, wherein the end portion of the arm is equipped with a hook which engages the second end of the film-mounting member.

8. The machine as claimed in claim 1, wherein said drive means is an electric motor.

9. The machine as claimed in claim 1, wherein said drive means comprises a spring and a rotary member which rotates by power accumulated in the spring.

10. The machine as claimed in claim 1, wherein the second end of said film mounting member has a hole therethrough which engages said support.

11. An automatic dental X-ray film developing machine, which comprises:

an annular member having a bottom wall, an outer peripheral wall, an inner peripheral wall and at least one partition wall, said at least one partition wall dividing an annular space, which is defined by the bottom wall, the outer peripheral wall and the inner peripheral wall, into plural compartments;

a film-mounting member having a first end and a second end, the first end having a holding portion for detachably holding a dental X-ray film, the second end having a hole therethrough;

a support for pivotably and releasably supporting the film-mounting member so as to allow the film-mounting member to be dragged over the at least one partition wall, so that the film can travel successively through the compartments, said support engaging the hole in the second end of said film-mounting member; and drive means for causing a relative angular displacement between the annular member and the support.

12. The machine as claimed in claim 11, wherein the annular member comprises three partition walls to divide the annular space into a first compartment to be filled with a developer, a second compartment to be filled with a fixer and a third compartment to be filled with a washing liquid.

13. The machine as claimed in claim 11, wherein the annular member comprises four partition walls to divide the annular space into a first compartment to be filled with a developer, a second compartment to be filled with a fixer, a third compartment to be filled with a washing liquid, and a fourth compartment to be used as a drying compartment.

14. The machine as claimed in claim 11, wherein the annular member comprises three partition walls to divide the annular space into a first compartment, a second compartment, and a third compartment, further comprising a developer-containing container removably disposed in said first compartment, a fixer-containing container removably disposed in said second compartment, and a washing-liquid-containing container removably disposed in said third compartment.

15. The machine as claimed in claim 11, wherein the annular member comprises four partition walls to divide the annular space into a first compartment, a second compartment, a third compartment and a fourth compartment, further comprising a developer-containing container removably disposed in said first compartment, a fixer-containing container removably disposed in said second compartment, and a washing-liquid-containing container removably disposed in said third compartment, wherein said fourth compartment is a drying compartment.

16. The machine as claimed in claim 11, wherein the annular member is fixed, the support is an arm provided on a rotary shaft of the drive means, and an end portion of the arm travels along and above the annular space of the annular member.

17. The machine as claimed in claim 16, wherein the end portion of the arm is equipped with a hook which engages the second end of the film-mounting member.

18. The machine as claimed in claim 11, wherein said drive means is an electric motor.

19. The machine as claimed in claim 1, wherein said drive means comprises a spring and a rotary member which rotates by power accumulated in the spring.

20. An automatic dental X-ray film developing machine, which comprises:

an annular member having a bottom wall, an outer peripheral wall, an inner peripheral wall and at least one partition wall, said at least one partition wall dividing an annular space, which is defined by the bottom wall, the outer peripheral wall and the inner peripheral wall, into plural compartments;

a film-mounting member for detachably holding a dental X-ray film;

a support for pivotably and releasably supporting the film-mounting member so as to allow the film to travel successively through the compartments; and drive means for causing a relative angular displacement between the annular member and the support;

wherein said at least one partition wall defines a tilted surface on the rearward side relative to the travelling direction of the film and the tilted surface extends upwardly in the travelling direction of the film.

21. An automatic dental X-ray film developing machine, which comprises:

an annular member having a bottom wall, an outer peripheral wall, an inner peripheral wall and at least one partition wall, said at least one partition wall dividing an annular space, which is defined by the bottom wall, the outer peripheral wall and the inner peripheral wall, into plural compartments;

a film-mounting member for detachably holding a dental X-ray film;

a support for pivotably and releasably supporting the film-mounting member so as to allow the film to travel successively through the compartments; and drive means for causing a relative angular displacement between the annular member and the support;

wherein the support is fixed, and the annular member is driven by said drive means so that all of the plural compartments are successively brought into cooperation with the fixed support.

* * * * *